US010104980B2

(12) United States Patent
Yang

(10) Patent No.: US 10,104,980 B2
(45) Date of Patent: Oct. 23, 2018

(54) BED SET WITH FOOTBOARD BENCH

(71) Applicant: Lei Yang, City of Industry, CA (US)

(72) Inventor: Lei Yang, City of Industry, CA (US)

(73) Assignee: Furniture of America, Inc., City of Industry, CA (US)

( * ) Notice: Subject to any disclaimer, the term of this patent is extended or adjusted under 35 U.S.C. 154(b) by 182 days.

(21) Appl. No.: 14/824,059

(22) Filed: Aug. 11, 2015

(65) Prior Publication Data

US 2017/0042337 A1 Feb. 16, 2017

(51) Int. Cl.

| | |
|---|---|
| ***A47C 31/00*** | (2006.01) |
| ***A47B 83/00*** | (2006.01) |
| ***A47C 19/22*** | (2006.01) |
| ***A47C 17/14*** | (2006.01) |
| ***A47C 17/62*** | (2006.01) |
| ***A47C 21/00*** | (2006.01) |
| ***A47C 19/02*** | (2006.01) |
| ***A47C 11/00*** | (2006.01) |

(52) U.S. Cl.

CPC ..... *A47C 19/22* (2013.01); *A47C 11/00* (2013.01); *A47C 19/022* (2013.01); *A47C 21/00* (2013.01); *A47C 31/00* (2013.01)

(58) Field of Classification Search

CPC ..... A47C 19/22; A47C 19/022; A47C 11/00; A47C 20/00; A47C 20/021; A47C 15/00; A47C 16/02; A47C 17/163; A47B 23/00

See application file for complete search history.

(56) References Cited

U.S. PATENT DOCUMENTS 713,529 A * 11/1902 Swindell ..... A61G 7/053 108/49
1,267,046 A * 5/1918 Beaird ..... A47B 5/04 108/135
2,551,151 A * 5/1951 McMurtrie ..... A47B 23/02 5/507.1
2,765,479 A * 10/1956 Sevcik ..... A47C 21/028 5/507.1
3,663,059 A * 5/1972 Omlie ..... A47C 4/028 297/440.2
3,796,459 A * 3/1974 Weber ..... A47C 1/121 297/42
4,602,817 A * 7/1986 Raftery ..... A47C 4/02 24/339

(Continued)

OTHER PUBLICATIONS https://www.hayneedle.com/product/republicdesignhousetuftedsofabedroombench.cfm.*

(Continued)

*Primary Examiner* — Peter M. Cuomo
*Assistant Examiner* — Rahib T Zaman
(74) *Attorney, Agent, or Firm* — Raymond Y. Chan; David and Raymond Patent Firm

(57) ABSTRACT

A bed set includes a bed frame which includes a headboard, and a footboard bench, wherein the footboard bench includes a base frame and a back frame upwardly extended from the base frame. The back frame of the footboard bench serves as a footboard of the bed frame to match with the headboard of the bed frame. In particular, an ornamental design of the back frame of the footboard bench matches with an ornamental design of the headboard of the bed frame, so as to enhance an aesthetic appearance of the bed set.

15 Claims, 4 Drawing Sheets

(56) References Cited

U.S. PATENT DOCUMENTS

| | | | | |
|---|---|---|---|---|
| 5,509,158 | A * | 4/1996 | Morrison | A47C 21/028 5/504.1 |
| 6,139,110 | A * | 10/2000 | Jeng | A47C 11/00 297/445.1 |
| 7,036,160 | B1 * | 5/2006 | Pecoraro | A47C 19/22 108/49 |
| 9,565,946 | B1 * | 2/2017 | Watton | A47C 7/405 |
| 2002/0124778 | A1 * | 9/2002 | Hwei | A47C 4/04 108/127 |
| 2003/0061654 | A1 * | 4/2003 | Lenner | A47C 19/022 5/2.1 |
| 2003/0145377 | A1 * | 8/2003 | Paul | A47C 19/022 5/53.1 |
| 2003/0209934 | A1 * | 11/2003 | Haney | A47C 11/00 297/440.15 |
| 2006/0282945 | A1 * | 12/2006 | Gallawa | A47C 19/22 5/2.1 |
| 2011/0074200 | A1 * | 3/2011 | Chen | A47C 11/00 297/451.8 |
| 2014/0310871 | A1 * | 10/2014 | Nassif | A47C 17/14 5/12.2 |

OTHER PUBLICATIONS http://bucketsofburlap.blogspot.com/2016/04/spring-bedroom-makeover.html.*
https://stylebyemilyhenderson.com/blog/end-bed-benches.*
https://www.pinterest.com/pin/240942648793138321/.*

* cited by examiner

BED SET WITH FOOTBOARD BENCH

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a bed structure, and more particular to a bed set with a footboard bench, wherein the bench serves as a footboard of the bed frame and as a back frame of the bench to provide multiple functions of the bed set.

Description of Related Arts

Most people would like to equip a bench with a bed frame to serve as a seat or as a rack. Generally speaking, the bench, such as a bedroom bench, only comprises a seat portion without any back support. Since the bench does not have any back support, the bench is not designed for the user to sit comfortably. In other words, the bench will become a non-functional decorative furniture or an end table for the user to place the bed accessories thereon.

Accordingly, the ornamental design of the bench may not match with the bed frame. In addition, the conventional bed frame may further comprise a footboard, wherein when the bedroom bench is placed to align with the footboard of the bed frame, the footboard of the bed frame may block by the bench. It is awful to place the bench adjacent to the footboard of the bed frame that the bench does not match with the overall appearance of the bed frame.

SUMMARY OF THE PRESENT INVENTION

The invention is advantageous in that it provides a bed set, which comprises a bed frame and a footboard bench, wherein the back frame of the footboard bench serves as a back support of the footboard bench and as a footboard of the bed frame to match with the headboard of the bed frame.

Another advantage of the invention is to provide a bed set, wherein an ornamental design of the back frame of the footboard bench matches with an ornamental design of the headboard of the bed frame so as to enhance an aesthetic appearance of the bed set.

Another advantage of the invention is to provide a bed set, wherein the width of the headboard of the bed frame matches with the width of the back frame of the footboard bench, such that the footboard bench is custom-made to equip with the bed frame.

Another advantage of the invention is to provide a bed set, wherein the back frame enhances the practical use of the footboard bench, such that the user is able to sit on the footboard bench comfortably.

Another advantage of the invention is to provide a bed set, which does not require to alter the original structural design of the bed frame, so as to minimize the manufacturing cost of the bed frame incorporating with the footboard bench.

Another advantage of the invention is to provide a bench, wherein the user does not require any assembling operation of the footboard bench to incorporate with the bed frame.

Another advantage of the invention is to provide a bench, wherein no expensive or complicated structure is required to employ in the present invention in order to achieve the above mentioned objects. Therefore, the present invention successfully provides an economic and efficient solution for providing an additional seating configuration for the bench to match with the bed frame.

Additional advantages and features of the invention will become apparent from the description which follows, and may be realized by means of the instrumentalities and combinations particular point out in the appended claims.

According to the present invention, the foregoing and other objects and advantages are attained by a bed set which comprises a bed frame and a footboard bench. The bed frame comprises a headboard.

The footboard bench comprises a base frame and a back frame upwardly extended from the base frame. The back frame of the footboard bench serves as a footboard of the bed frame to match with the headboard of the bed frame. In particular, an ornamental design of the back frame of the footboard bench matches with an ornamental design of the headboard of the bed frame, so as to enhance an aesthetic appearance of the bed set.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
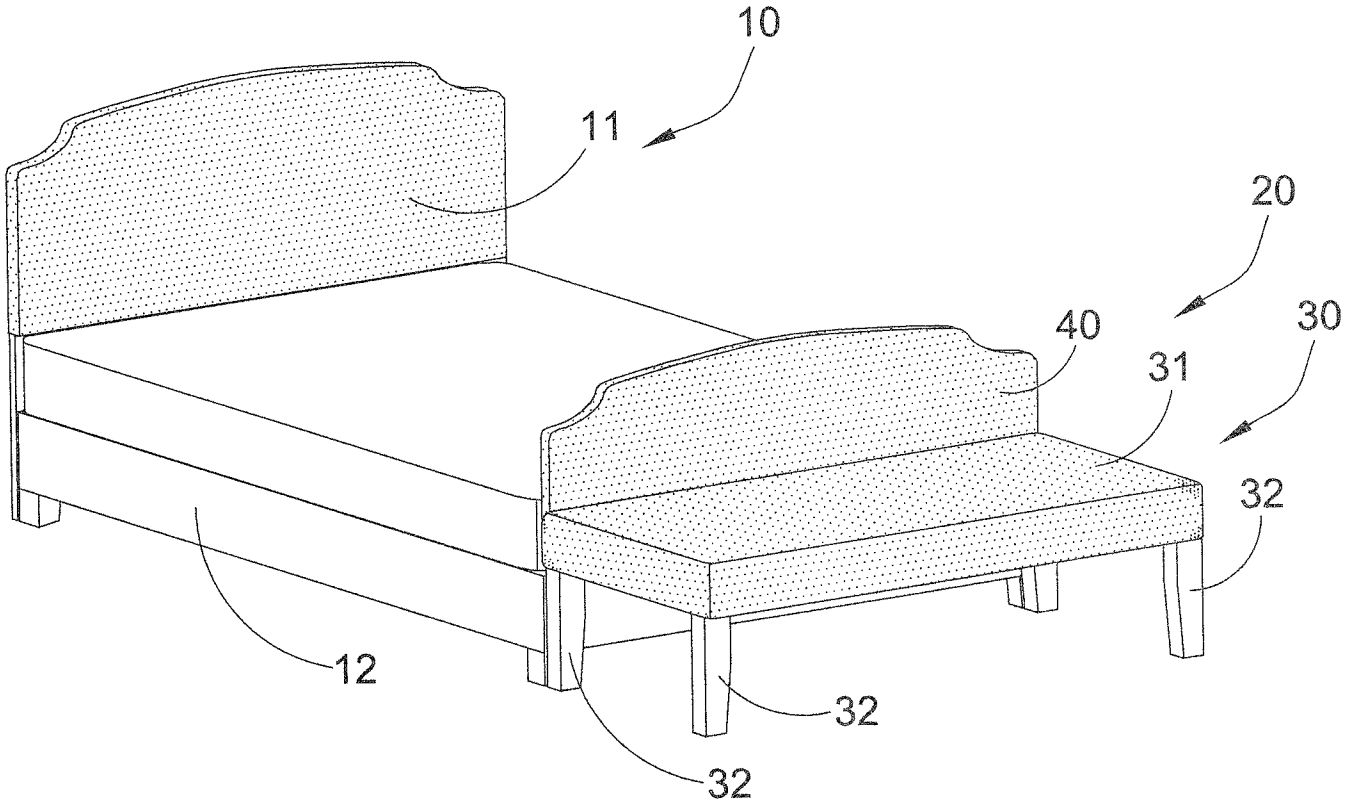
FIG. 1 is a perspective view of a bed set according to a preferred embodiment of the present invention.
Figure 2:
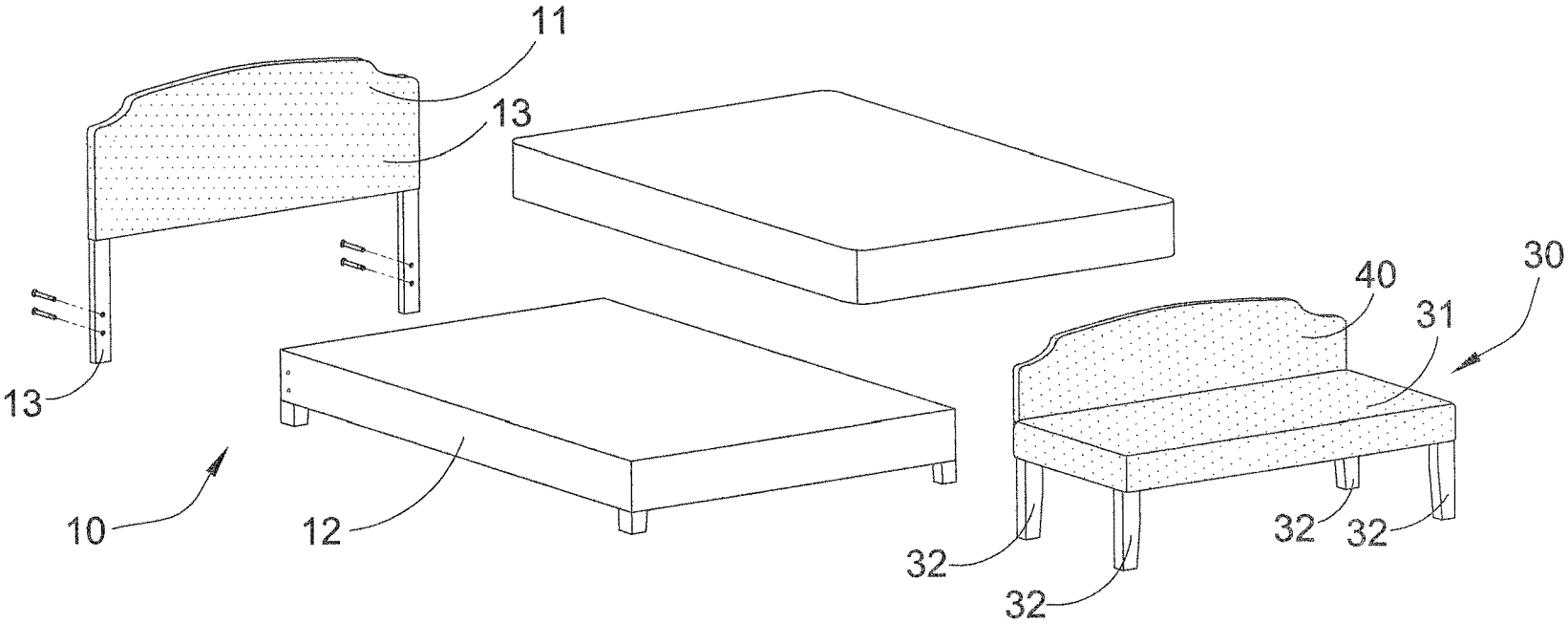
FIG. 2 is an exploded perspective view of a bed set according to the above preferred embodiment of the present invention.
Figure 3:
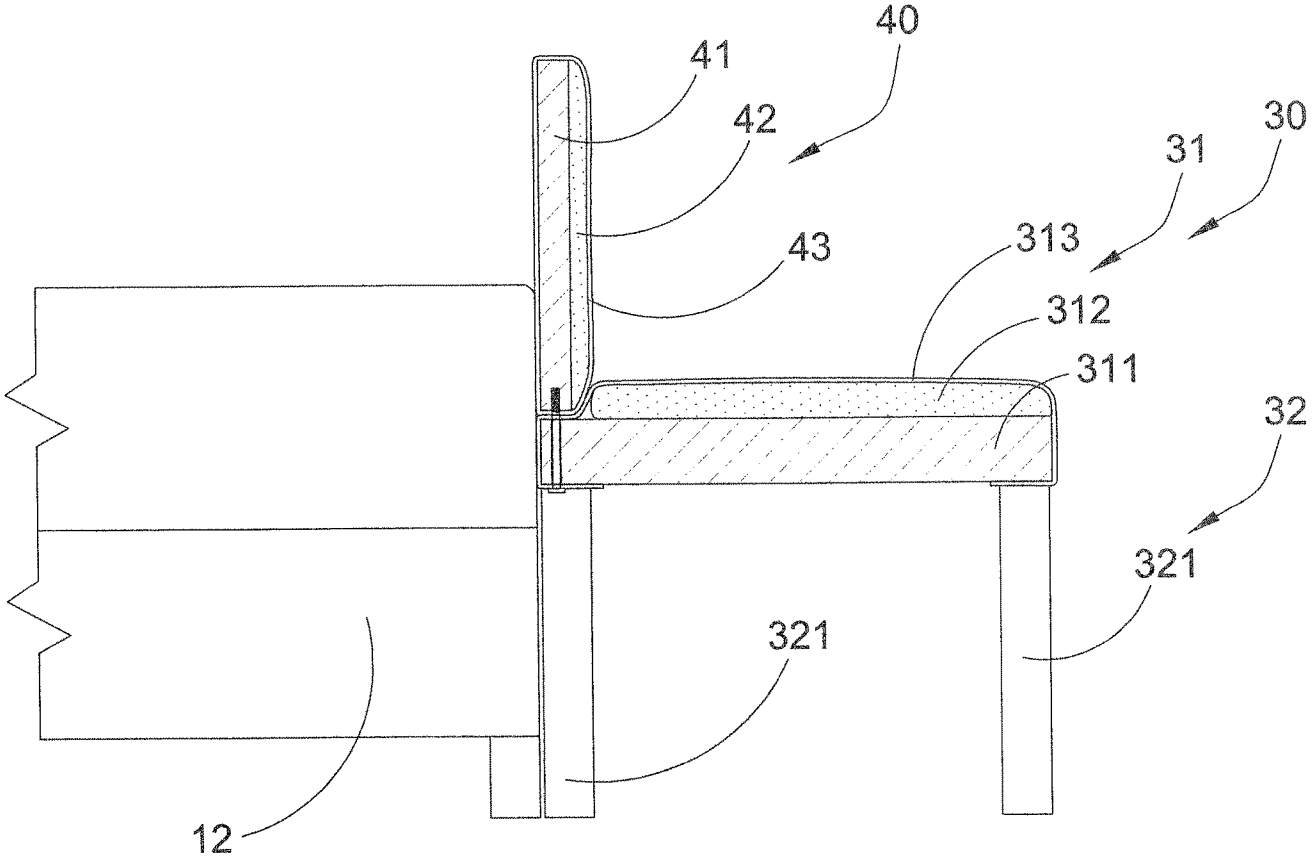
FIG. 3 is a side sectional view of the footboard bench of the bed set according to the above preferred embodiment of the present invention.

Referring to FIGS. 1 to 3 of the drawings, a bed set according to a preferred embodiment of the present invention is illustrated, wherein the bed set comprises a bed frame 10 and a footboard bench 20 which serves as the bedroom bench.

According to the preferred embodiment, the bed frame 10 comprises a headboard 11 and a mattress supporting frame 12 for supporting a mattress pad thereon. The headboard 11 is located at a head end of the mattress supporting frame 12.

In particular, the bed frame 10 comprises a headboard attachment 13 extended from the headboard 11 to detachably couple the headboard 11 to the head end of the mattress supporting frame 12. As shown in FIG. 2, the headboard attachment 13 comprises an extension leg downwardly extended from the headboard 11 to detachably couple with the head end of the mattress supporting frame 12.

The footboard bench 20 comprises a base frame 30 and a back frame 40 upwardly extended from the base frame 30, wherein the back frame 40 of the footboard bench 20 serves as a footboard of the bed frame 10 to match with the headboard 11 of the bed frame 10. In particular, the shape of the back frame 40 of the footboard bench 20 matches with the shape of the headboard 11 of the bed frame 10. Furthermore, an ornamental design of the back frame 40 of the footboard bench 20 matches with an ornamental design of the headboard 11 of the bed frame 10, so as to enhance an aesthetic appearance of the bed set.

Accordingly, the width of the headboard 11 of the bed frame 10 matches with the width of the back frame 40 of the footboard bench 20. A top edge of the headboard 11 of the bed frame 10 is higher than a top edge of the back frame 40 of the footboard bench 20.

As shown in FIGS. 2 and 3, the base frame 30 of the footboard bench 20 comprises a seat frame 31 and a leg frame 32 downwardly extended from the seat frame 31 at a position that the seat frame 31 is located above the mattress supporting frame 12. Accordingly, the back frame 40 is upwardly and perpendicularly extended from a rear portion of the seat frame 31.

The seat frame 31 comprises a seat supporting panel 311, a seat cushion 312 overlapped on the seat supporting panel 311, and a top enclosing layer 313 that wraps the seat cushion 312 on the seat supporting panel 311. As shown in FIG. 3, the seat supporting panel 311 is made of rigid material, such as wood panel, and has a top side and a bottom side. The seat cushion 312 is placed on the top side of the seat supporting panel 311, such that a user is able to sit on the seat frame 31 comfortably. The top enclosing layer 313 wraps the seat cushion 312 on the top side of the seat supporting panel 311 and affixes to the bottom side of the seat supporting panel 311. It is worth mentioning that the width of the seat frame 31 matches with the width of the mattress supporting frame 12 of the bed frame 10, such that the footboard bench of the present invention can be placed at a foot end of the bed frame 10 to serve as the bedroom bench. It is worth mentioning that the footboard bench of the present invention can be placed in any other desired location in the room.

The leg frame 32 comprises a plurality of supporting legs 321, preferably four supporting legs 321, spacedly and downwardly extended from the bottom side of the seat supporting panel 311 at corner portions thereof respectively.

The back frame 40 is upwardly extended from the seat frame 30. In particular, the back frame 40 is upwardly and perpendicularly extended from a rear portion of the seat frame 30. As shown in FIG. 3, the back frame 40 comprises a back supporting panel 41 upwardly extended from the seat frame 30, a back cushion 42 overlapped on the back supporting panel 41, and a back enclosing layer 43 that wraps the back cushion 42 at the back supporting panel 41.

Accordingly, the back supporting panel 41 is made of rigid material, such as wood panel, and has a front side and a rear side. The back cushion 42 is placed at the front side of the back supporting panel 41, such that a user's back is able to support via the back frame 40 comfortably. The back enclosing layer 43 wraps the back cushion 42 on the front side of the back supporting panel 41 and affixes to the rear side of the back supporting panel 41. It is worth mentioning that the width of the seat frame 30 matches with the width of the back frame 30.

According to the preferred embodiment, a bottom edge of the back supporting panel 41 of the back frame 40 is upwardly and perpendicularly coupled with a rear edge of the seat supporting panel 311 of the seat frame 31.

Figure 4:
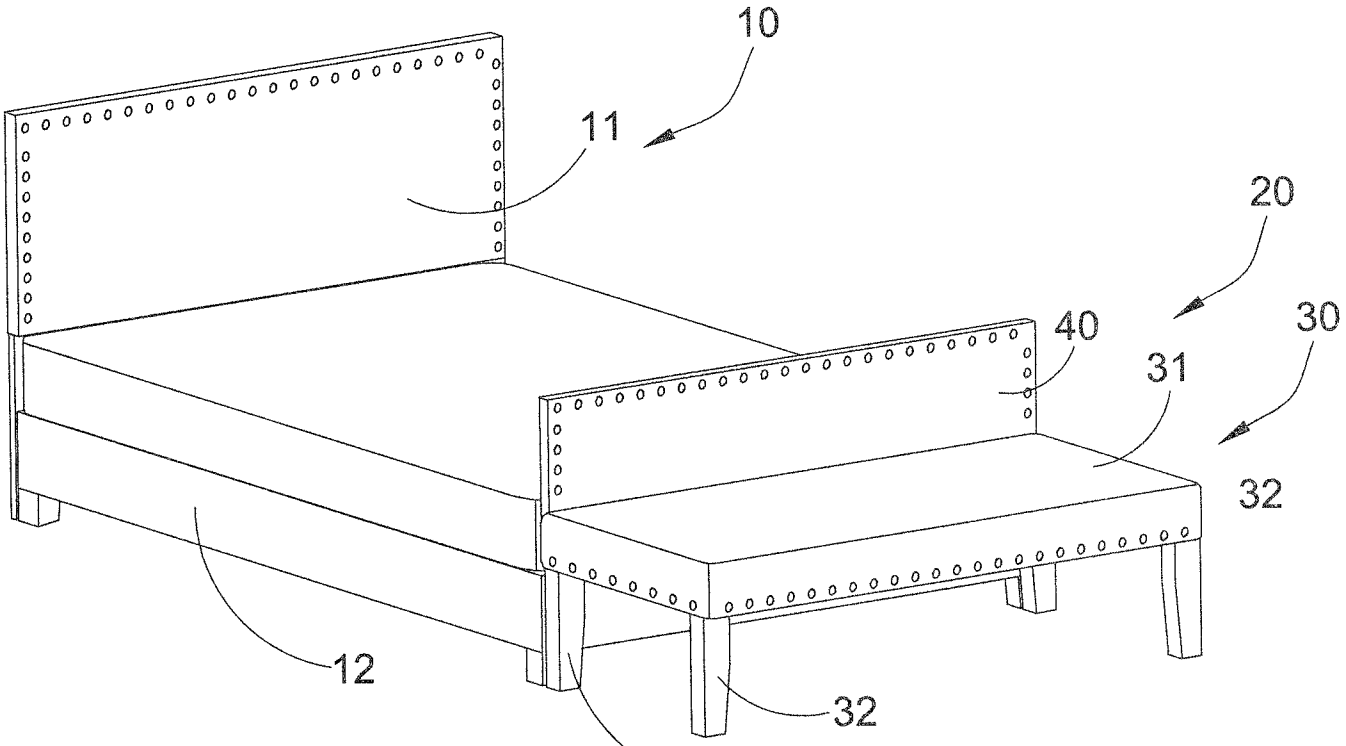
FIG. 4 illustrates another ornamental design of the back frame of the footboard bench matches with the ornamental design of the headboard of the bed frame according to the above preferred embodiment of the present invention.

According to the preferred embodiment, the mattress supporting frame 12 of the bed frame 10 and the base frame 30 of the footboard bench 20 can be manufactured as the universal frame. For example, when the manufacturer manufactures a queen size mattress supporting frame 12, the queen sized base frame 30 will be made to match with the size of the mattress supporting frame 12. Then, the manufacturer is able to manufacture the back frame 40 of the footboard bench 20 with the headboard 11 of the bed frame 10 to match the ornamental design of the back frame 40 of the footboard bench 20 with the ornamental design of the headboard 11 of the bed frame 10 as a pair of decorative boards, so as to enhance an aesthetic appearance of the bed set, as shown in FIGS. 1 and 4. As a result, the headboard 11 and the back frame 40 can be respectively affixed to the mattress supporting frame 12 and the footboard bench 20, such that when the footboard bench 20 is placed at the foot end of the bed frame 10, the back frame 40 not only serves as a back support of the footboard bench 20 but also serves as a footboard of the bed frame 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bed set, comprising: a bed frame; a footboard bench which comprises a base frame; and a pair of decorative boards which are a headboard of said bed frame and a back frame of said footboard, wherein said headboard is identical to said back frame in shape but is different to said back frame in height, wherein an ornamental design of said back frame of said footboard bench matches with an ornamental design of said headboard of said bed frame, wherein said back frame is upwardly extended from said base frame, wherein said back frame of said footboard bench serves as a footboard of said bed frame, wherein said footboard bench is placed at a foot end of the bed frame; wherein said bed frame further comprises a mattress supporting frame for supporting a mattress thereon, wherein said headboard is affixed to a head end of said mattress supporting frame while said footboard bench is aligned with and removable from a foot end of said mattress supporting frame; wherein said bed frame and said footboard bench are functional when removed from each other.

2. The bed set, as recited in claim 1, wherein a width of said headboard of said bed frame matches with a width of said back frame of said footboard bench.

3. The bed set, as recited in claim 1, wherein a top edge of said headboard of said bed frame is higher than a top edge of said back frame of said footboard bench.

4. The bed set, as recited in claim 2, wherein a top edge of said headboard of said bed frame is higher than a top edge of said back frame of said footboard bench.

5. The bed set, as recited in claim 2, a wherein said bed frame further comprises a mattress supporting frame for supporting a mattress thereon, wherein said headboard is affixed to a head end of said mattress supporting frame while said footboard bench is aligned with and removable from a foot end of said mattress supporting frame.

6. The bed set, as recited in claim 4, a wherein said bed frame further comprises a mattress supporting frame for supporting a mattress thereon, wherein said headboard is affixed to a head end of said mattress supporting frame while said footboard bench is aligned with and removable from a foot end of said mattress supporting frame.

7. The bed set, as recited in claim 6, wherein said base frame comprises a seat frame and a leg frame downwardly extended from said seat frame at a position that said seat frame is located above said mattress supporting frame, wherein said back frame is upwardly and perpendicularly extended from a rear portion of said seat frame.

8. The bed set, as recited in claim 5, wherein said base frame comprises a seat frame and a leg frame downwardly extended from said seat frame at a position that said seat frame is located above said mattress supporting frame, wherein said back frame is upwardly and perpendicularly extended from a rear portion of said seat frame.

9. The bed set, as recited in claim 6, wherein said base frame comprises a seat frame and a leg frame downwardly extended from said seat frame at a position that said seat frame is located above said mattress supporting frame, wherein said back frame is upwardly and perpendicularly extended from a rear portion of said seat frame.

10. The bed set, as recited in claim 7, wherein said back frame comprises a back supporting panel upwardly extended from said seat frame, a back cushion overlapped on said back supporting panel, and a back enclosing layer that wraps said back cushion at said back supporting panel.

11. The bed set, as recited in claim 8, wherein said back frame comprises a back supporting panel upwardly extended from said seat frame, a back cushion overlapped on said back supporting panel, and a back enclosing layer that wraps said back cushion at said back supporting panel.

12. The bed set, as recited in claim 9, wherein said back frame comprises a back supporting panel upwardly extended from said seat frame, a back cushion overlapped on said back supporting panel, and a back enclosing layer that wraps said back cushion at said back supporting panel.

13. The bed set, as recited in claim 10, wherein said seat frame comprises a seat supporting panel, a seat cushion overlapped on said seat supporting panel, and a top enclosing layer that wraps said seat cushion on said seat supporting panel, wherein a bottom edge of said back supporting panel of said back frame is upwardly and perpendicularly coupled with a rear edge of said seat supporting panel of said seat frame.

14. The bed set, as recited in claim 11, wherein said seat frame comprises a seat supporting panel, a seat cushion overlapped on said seat supporting panel, and a top enclosing layer that wraps said seat cushion on said seat supporting panel, wherein a bottom edge of said back supporting panel of said back frame is upwardly and perpendicularly coupled with a rear edge of said seat supporting panel of said seat frame.

15. The bed set, as recited in claim 12, wherein said seat frame comprises a seat supporting panel, a seat cushion overlapped on said seat supporting panel, and a top enclosing layer that wraps said seat cushion on said seat supporting panel, wherein a bottom edge of said back supporting panel of said back frame is upwardly and perpendicularly coupled with a rear edge of said seat supporting panel of said seat frame.

* * * * *